US012275568B2

(12) United States Patent
Warashina

(10) Patent No.: US 12,275,568 B2
(45) Date of Patent: Apr. 15, 2025

(54) PACKAGING BAG, METHOD OF MANUFACTURING PACKAGING BAG, AND SHEET PACKAGE

(71) Applicant: DAIO PAPER CORPORATION, Ehime (JP)

(72) Inventor: Shinichi Warashina, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 0 days.

(21) Appl. No.: 18/256,755

(22) PCT Filed: Jan. 18, 2022

(86) PCT No.: PCT/JP2022/001561
§ 371 (c)(1),
(2) Date: Jun. 9, 2023

(87) PCT Pub. No.: WO2022/176476
PCT Pub. Date: Aug. 25, 2022

(65) Prior Publication Data

US 2024/0025609 A1 Jan. 25, 2024

(30) Foreign Application Priority Data

Feb. 22, 2021 (JP) ..... 2021-025872

(51) Int. Cl.
*B65D 65/40* (2006.01)
*B65D 75/08* (2006.01)

(52) U.S. Cl.
CPC ..... *B65D 65/40* (2013.01); *B65D 75/08* (2013.01); *B65D 2565/382* (2013.01)

(58) Field of Classification Search
CPC ..... B65D 65/40; B65D 2565/382
USPC ..... 206/484, 391
See application file for complete search history.

(56) References Cited

U.S. PATENT DOCUMENTS 3,460,671 A * 8/1969 Alson ..... B65D 71/08 206/391
4,886,167 A * 12/1989 Dearwester ..... B65D 85/672 206/83.5
2020/0369447 A1* 11/2020 Anklam ..... B32B 27/304

FOREIGN PATENT DOCUMENTS

| | | | |
|---|---|---|---|
| EP | 4276033 | | 11/2023 |
| JP | H03-109830 U | | 11/1991 |
| JP | 2004-338729 | | 12/2004 |
| JP | 2007269348 | * | 10/2007 |
| JP | 2008-183034 | | 8/2008 |
| JP | 2008007922 | * | 10/2009 |
| JP | 2014-221648 | | 11/2014 |
| JP | 2014221648 A | * | 11/2014 |
| JP | 2015-175081 | | 10/2015 |

(Continued)

OTHER PUBLICATIONS

International Search Report for PCT/JP2022/001561 mailed on Mar. 15, 2022.

(Continued)

*Primary Examiner* — Rafael A Ortiz
(74) *Attorney, Agent, or Firm* — IPUSA, PLLC

(57) ABSTRACT

A packaging bag configured to pack a sheet in a folded-packaged manner includes a paper layer including a paper component, and a resin layer including a thermoplastic resin provided on both surfaces of the paper layer, wherein a proportion of the paper component in the packaging bag is 45% or more.

8 Claims, 4 Drawing Sheets

(56) References Cited

FOREIGN PATENT DOCUMENTS

| | | | | |
|---|---|---|---|---|
| JP | 2018-090255 | | | 6/2018 |
| JP | 2018-090270 | | | 6/2018 |
| JP | 2018-090320 | | | 6/2018 |
| JP | 2018090270 | A | * | 6/2018 |
| JP | 2018-177364 | | | 11/2018 |
| JP | 2019-056515 | | | 4/2019 |
| JP | 6721773 | | | 7/2020 |
| JP | 2020-152385 | | | 9/2020 |
| JP | 2021-123339 | | | 8/2021 |
| JP | 2021-167216 | | | 10/2021 |
| JP | 2021-187483 | | | 12/2021 |
| JP | 2021-187484 | | | 12/2021 |

OTHER PUBLICATIONS

International Search Report for PCT/JP2021/047536 mailed on Mar. 15, 2022.

* cited by examiner

PACKAGING BAG, METHOD OF MANUFACTURING PACKAGING BAG, AND SHEET PACKAGE

FIELD OF THE INVENTION

The present invention relates to a packaging bag, a method of manufacturing a packaging bag, and a sheet package.

BACKGROUND OF THE INVENTION

A sheet package in which a sheet roll such as toilet paper and the like is packaged is distributed in a state where a plurality of sheet rolls is packaged in a packaging bag made of a resin film (for example, Patent Document 1).

In recent years, there has been a movement to change materials of packaging bags that contain sheet rolls from plastic to paper from the perspective of curbing environmental burdens such as global warming caused by $CO_2$ emissions and marine pollution from microplastics.

RELATED-ART DOCUMENT

Patent Documents

Patent Document 1: Japanese Patent Application Laid-Open No. 2018-90255

SUMMARY OF THE INVENTION

Problems to be Solved by the Invention

However, when the packaging bag of the sheet package is made of paper, since the paper-made packaging bag is not flexible as compared with a resin-made packaging bag, the packaging bag is broken or the seal portion of the packaging bag is peeled off during manufacture or transportation of the sheet package. As a result, the properties of packaging are deteriorated.

An object of the present invention is to provide a paper-made packaging bag which suppresses deterioration of packaging property.

Means for Solving the Problems

A packaging bag configured to pack a sheet in a folded-packaged manner includes a paper layer including a paper component, and a resin layer including a thermoplastic resin provided on both surfaces of the paper layer, wherein a proportion of the paper component in the packaging bag is 45% or more.

Effects of the Invention

One aspect of the present invention provides a packaging bag made of paper that suppresses a decrease in packaging property.

DETAILED DESCRIPTION OF THE INVENTION

<Sheet Package>

Figure 1:
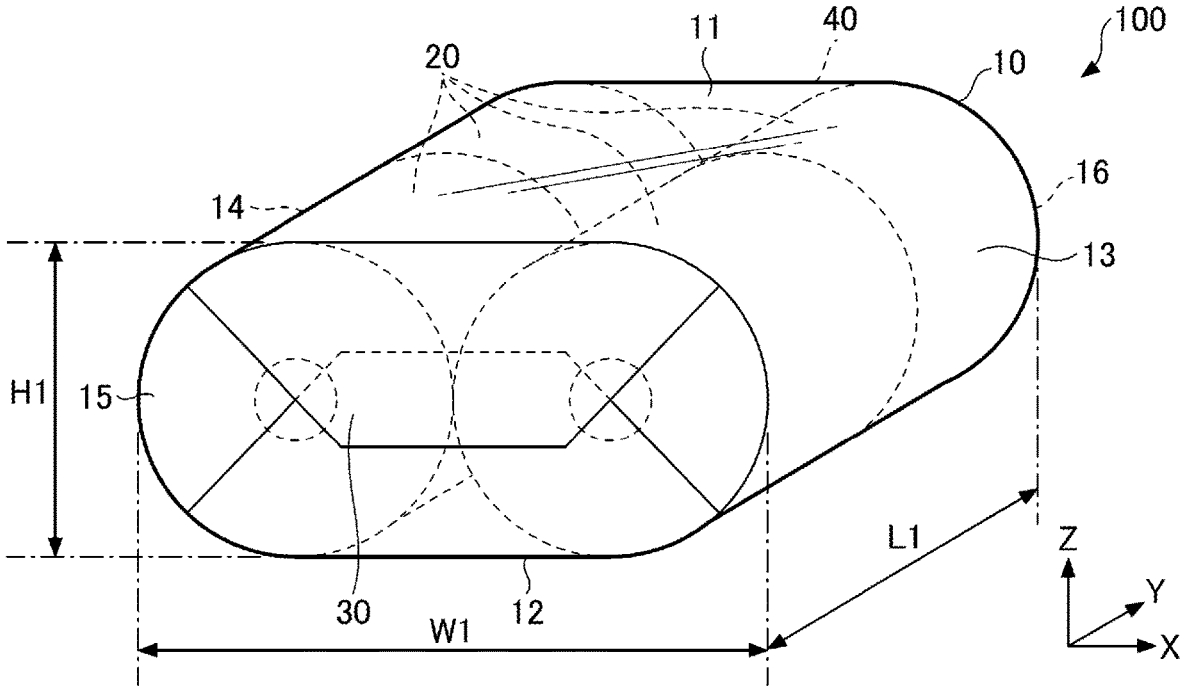
FIG. 1 is a diagram illustrating a sheet package in which a sheet roll is packaged in a packaging bag.

An embodiment of the present invention will be described in detail with reference to the drawings. In the drawings, common portions are denoted by the same reference numerals, and description thereof may be omitted. In addition, in each drawing, the scale of each member may be different from the actual scale. In each drawing, a three-dimensional orthogonal coordinate system having three axis directions (X-direction, Y-direction, and Z-direction) is used, and a width direction of a packaging bag is defined as the X-direction, a longitudinal direction is defined as the Y-direction, and a height direction (vertical direction or thickness direction) is defined as the Z-direction.

Figure 2:
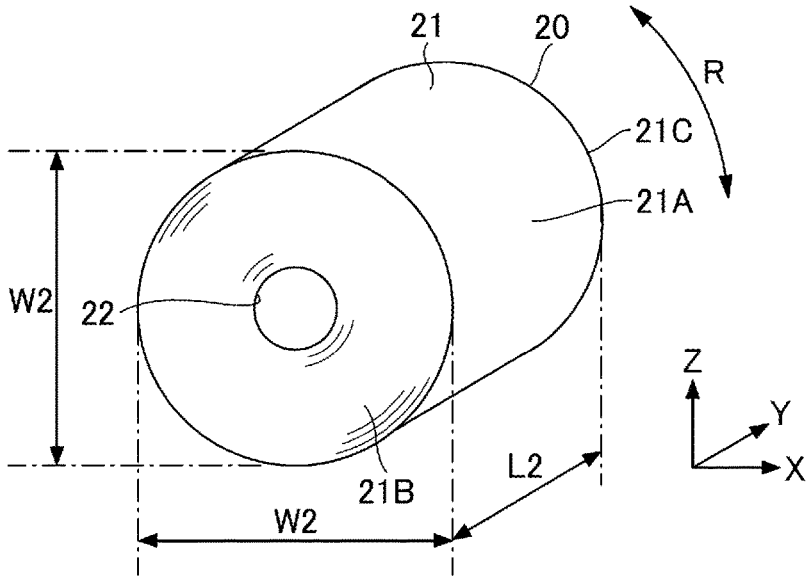
FIG. 2 is a diagram illustrating the sheet roll packaged in the packaging bag.
Figure 3:
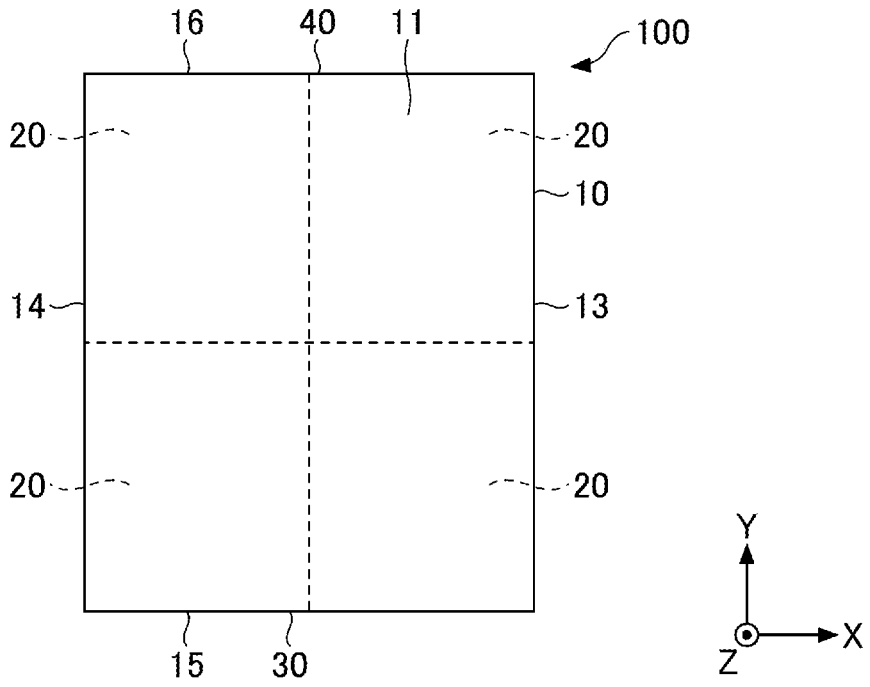
FIG. 3 is a diagram of the sheet package illustrated in FIG. 1 viewed from the top surface.

FIG. 1 is a diagram illustrating a sheet package in which sheet rolls are packaged in a packaging bag according to an embodiment. FIG. 2 is a diagram illustrating a sheet roll packaged in the packaging bag. FIGS. 3, 4, 5, 6, 7, and 8 are diagrams of the sheet package illustrated in FIG. 1 viewed from top surface, bottom surface, one side surface, the other side surface, one end surface, and the other end surface, respectively. The sheet package 100 is an example of the sheet package according to the present embodiment, and includes a packaging bag 10 and sheet rolls 20.

<Sheet>

The sheet roll 20 is an example of a sheet packaged in the packaging bag according to the present embodiment. As illustrated in FIG. 1, four sheet rolls are packaged in the packaging bag 10. As illustrated in FIG. 2, the sheet roll 20 is formed by winding a long sheet 21 around a hollow core 22. The sheet is not limited to a sheet roll in the present embodiment, and may be a sheet laminate in which a plurality of sheets is laminated.

The forms of the sheet roll 20 are not particularly limited. For example, the sheet roll 20 can be applied to sanitary tissue paper such as toilet paper, kitchen paper, paper towels, tissue paper, and the like. The use of the sheet roll 20 is not particularly limited, and can be applied to any of industrial use, domestic use, and portable use. Among them, toilet paper for home use is preferably used as the sheet roll 20 in the present embodiment.

A circumferential surface 21A of the sheet roll 20 faces a top surface 11, a bottom surface 12, a side surface 13, and a side surface 14 of the packaging bag 10, and a part of the circumferential surface 21A is in contact with a part of another circumferential surface 21A of the adjacent sheet roll 20. Among four sheet rolls 20, in the two sheet rolls positioned on the side of the end surface 15 of the packaging bag 10, end surfaces 21B of the sheet rolls 20 face the end surface 15 of the packaging bag 10, and in the two sheet rolls positioned on the side of the end surface 16 of the packaging bag 10, end surfaces 21C of the sheet rolls 20 face the end surface 16 of the packaging bag 10.

The size of the sheet roll 20 is not particularly limited, but a width (width of the roll) L2 of the long sheet 21 in the width direction (Y-direction) is preferably in a range from 85 mm to 400 mm, and a diameter (diameter of the roll) W2 of the long sheet 21 in the radial direction (X-direction or Z-direction) is preferably in a range from 80 mm to 200 mm (see FIG. 2).

The number of plies of the long sheet 21 is not particularly limited, but can be one ply or more, and is preferably one ply or two plies (two-ply sheet).

The material of the long sheet 21 is not particularly limited. For example, a sheet such as paper, nonwoven fabric, cloth, or the like can be used, and paper (paper sheet) is preferably used. When the long sheet 21 is a paper sheet, base paper containing pulp as a main raw material is used. As a pulp composition, a known composition in a paper sheet can be used. For example, the blending proportion of the pulp can be adjusted to 50% by mass or more, preferably 90% by mass or more, and more preferably 100% by mass.

The composition of pulp in the long sheet 21 (paper sheet) is not particularly limited. For example, conifer pulp such as Needle Bleached Kraft Pulp (NBKP) or Needle Unbleached Kraft Pulp (NUKP) and hardwood pulp such as Leaf Bleached Kraft Pulp (LBKP) or Leaf Unbleached Kraft Pulp (LUKP) can be used at any ratio.

The ratio of the hardwood pulp to the conifer pulp is not limited, but is preferably 10:90 to more preferably, the proportion of the conifer pulp is higher than the proportion of the hardwood pulp in the pulp composition. Used paper pulp may be used as the pulp contained in the long sheet 21 (paper sheet).

A basis weight of the long sheet 21 is not particularly limited. In the case of paper, depending on the number of plies, the basis weight is in a range from 5 g/m$^2$ to 80 g/m$^2$, preferably in a range from 10 g/m$^2$ to 60 g/m$^2$, and more preferably in a range from 10 g/m$^2$ to 45 g/m$^2$. In addition, in the case of a nonwoven fabric, a basis weight is preferably in a range from 20 g/m$^2$ to 100 g/m$^2$. The basis weight is measured in accordance with JIS P 8124 (2011).

In addition, a thickness of the long sheet 21 (paper sheet) is not particularly limited, and a paper thickness measured under the environment in accordance with JIS P 8111 (1998) can be adopted. For example, when the long sheet 21 is paper, the paper thickness per two plies is in a range from 50 μm to 600 μm, preferably in a range from 60 μm to 500 μm, and more preferably in a range from 130 μm to 400 μm.

The long sheet 21 (paper sheet) may be embossed. Such embossing can be carried out by using conventional embossing methods.

The hollow core 22 is a cylindrical winding core in which the long sheet 21 is to be wound in the radial direction (R-direction) of the cylindrical winding core (see FIG. 2). Further, the hollow core 22 includes a structure in which no winding core is present (coreless structure). The material of the hollow core 22 is not particularly limited, and paper, resin, or the like can be used.

The form of the hollow core 22 is not particularly limited. For example, in the case where the hollow core 22 is a paper tube, the hollow core 22 may be formed of a single layer of cardboard or a plurality of layers of cardboard, or may be base paper of cardboard on which printing or application of deodorant is performed in advance. In addition, the winding method of the paper tube is not particularly limited, and may be any of a flat winding method, a spirally winding method (so-called spiral paper tube), and the like.

The size of the hollow core 22 is not particularly limited. For example, the length of the hollow core 22 in the longitudinal direction (Y-direction) is about the same as the roll width of the sheet roll 20 in the width direction (Y-direction) (in a range from 85 mm to 400 mm). The diameter of the hollow core 22 in the radial direction (X-direction or Z-direction) is in a range from 33 mm to 50 mm, and preferably in a range from 35 mm to 45 mm (see FIG. 2).

<Packaging Bag>

Figure 9:
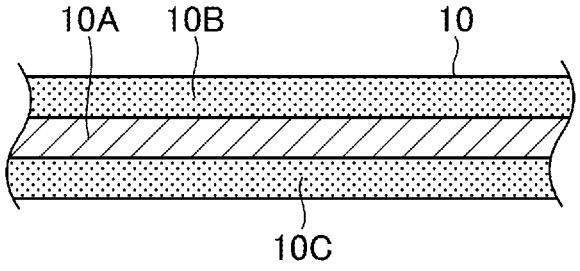
FIG. 9 is a diagram illustrating a cross-sectional view of the packaging bag.

The packaging bag 10 is an example of a packaging bag according to the present embodiment. The packaging bag 10 includes a paper layer 10A containing paper components, and resin layers 10B and 10C containing thermoplastic resins provided on both surfaces of the paper layer 10A (FIG. 9). In the present embodiment, the packaging bag 10 includes a three-layer structure in which resin layers (the resin layers 10B and 10C) are laminated on both the front and back surfaces of the paper layer 10A (FIG. 9).

Further, in the packaging bag 10, the proportion of the paper component in the packaging bag is 45% or more. Here, the paper component is, for example, a material (pulp) in which plant fibers are agglutinated. The pulp composition in the paper component is not particularly limited, for example, the ratio of the hardwood pulp to the conifer pulp is 0:100 to 70:30, and preferably the proportion of the conifer pulp is higher than the proportion of the hardwood pulp in the pulp composition. Recycled paper pulp may be used as the pulp.

The material of the paper layer 10A constituting the packaging bag 10 is not particularly limited, but can be formed of, for example, kraft paper or rayon paper. Kraft paper is paper made from kraft pulp. Rayon paper is a mixture of kraft pulp and rayon fibers chemically synthesized from wood pulp or the like. From the viewpoint of achieving both softness and strength of the packaging bag 10, rayon paper preferably has a blending proportion of rayon fibers of 20% or less in mass ratio.

The basis weight of the paper layer 10A constituting the packaging bag 10 is not limited, but is preferably in a range from 10 g/m$^2$ to 40 g/m$^2$, more preferably in a range from 15 g/m$^2$ to 35 g/m$^2$, and even more preferably in a range from 20 g/m$^2$ to 30 g/m$^2$. The basis weight of the paper layer is measured in accordance with JIS P 8124 (2011).

The thickness of the paper layer 10A constituting the packaging bag 10 is not limited, but for example, is preferably in a range from 20 μm to 100 μm, more preferably in a range from 25 μm to 90 μm, and even more preferably in a range from 40 μm to 75 μm. The thickness of the layer is measured in accordance with JIS P 8118 (2014).

The material of the thermoplastic resin contained in the resin layers 10B and 10C constituting the packaging bag 10 is not particularly limited, but is preferably low-density polyethylene. The low-density polyethylene may be any of high-pressure Low-Density Polyethylene (LDPE) and Linear Low-Density Polyethylene (L-LDPE).

Thicknesses of the resin layers 10B and 10C constituting the packaging bag 10 are not limited, but the thickness of each layer (per layer) of the resin layers 10B and 10C is preferably in a range from 5 μm to 40 μm, more preferably in a range from 7 μm to 35 μm, and even more preferably in a range from 9 μm to 30 μm. The thickness is measured in accordance with JIS P 8118 (2014).

The basis weight of the packaging bag 10 is not limited, but is preferably in a range from 20 g/m$^2$ to 70 g/m$^2$, more preferably in a range from 25 g/m$^2$ to g/m$^2$, and even more preferably in a range from 30 g/m$^2$ to 60 g/m$^2$. The basis weight of the packaging bag is measured in accordance with JIS P 8124 (2011).

The thickness of the packaging bag 10 is not limited, but is, for example, in a range from 25 μm to 105 μm, preferably in a range from 30 μm to 95 μm, and more preferably in a range from 45 μm to 80 μm. The thickness of the packaging bag is measured in accordance with JIS P 8118 (2014).

The density of the packaging bag 10 is not limited, and is, for example, in a range from 0.1 g/m$^3$ to 1.5 g/m$^3$, preferably in a range from 0.3 g/m$^3$ to 1.2 g/m$^3$, and more preferably in a range from 0.5 g/m$^3$ to 0.9 g/m$^3$. The density of the packaging bag is measured in accordance with JIS P 8118 (2014).

The tensile strength of the packaging bag in the longitudinal direction of the fibers (the flow direction or the machine direction during manufacture) is not limited, but is, for example, in a range from 1 kN/m to 6 kN/m, preferably in a range from 1.3 kN/m to 5.5 kN/m, and more preferably in a range from 1.5 kN/m to 5 kN/m. In addition, the tensile strength of the packaging bag in the lateral direction (the direction orthogonal to the flow direction or CD direction during manufacture) is in a range from 0.1 kN/m to 2.5 kN/m, preferably in a range from 0.2 kN/m to 2.4 kN/m, and more preferably in a range from 0.3 kN/m to 2.3 kN/m. The tensile strength of the packaging bag is measured in accordance with JIS P 8113 (2006).

The tear strength of the packaging bag 10 in the longitudinal direction (MD direction) of the fiber is not limited, but is, for example, in a range from 70 mN to 350 mN, preferably in a range from 80 mN to 340 mN, and more preferably in a range from 90 mN to 330 mN. Further, the tear strength of the packaging bag 10 in the lateral direction (CD direction) of the fiber is in a range from 250 mN to 950 mN, preferably in a range from 280 mN to 930 mN, and more preferably in a range from 300 mN to 920 mN. The tear strength of the packaging bag is measured in accordance with JIS P 8116 (2000).

The softness of the packaging bag 10 is not limited. For example, the softness of the fiber in the longitudinal direction (MD direction) is in a range from 90 mN/100 mm to 800 mN/100 mm, preferably in a range from 110 mN/100 mm to 750 mN/100 mm, more preferably in a range from 130 mN/100 mm to 730 mN/100 mm. The softness of the fiber in the lateral direction (CD direction) is in a range from 40 mN/100 mm to 330 mN/100 mm, preferably in a range from 50 mN/100 mm to 310 mN/100 mm, and more preferably in a range from 60 mN/100 mm to 310 mN/100 mm. The softness of the packaging bag is measured based on the handle-o-meter method in accordance with the JIS L 1096 E method.

The packaging bag 10 includes a top surface 11, a bottom surface 12, a side surface 13, a side surface 14, an end surface 15, and an end surface 16. In the packaging bag 10, the top surface 11 and the bottom surface 12 face each other in the up-down direction (Z-direction), the side surface 13 and the side surface 14 face each other in the width direction (X-direction), and the end surface 15 and the end surface 16 face each other in the longitudinal direction (Y-direction). The end surfaces 15 and 16 are continuous with all of the top surface 11, the bottom surface 12, the side surface 13, and the side surface 14 (FIGS. 1 and 3 to 8).

Although the size of the packaging bag 10 is not particularly limited, for example, the length L1 in the longitudinal direction (Y-direction) of the packaging bag 10 is in a range from 170 mm to 800 mm, the width W1 in the width direction (X-direction) orthogonal to the longitudinal direction (Y-direction) of the packaging bag 10 is in a range from 160 mm to 400 mm, and the height H1 in the height direction (Z-direction) is in a range from 160 mm to 400 mm. The size of the packaging bag 10 is a size in which four sheet rolls 20 are packaged in the packaging bag 10.

In the packaging bag 10, an opening (not illustrated) of the packaging bag 10 may be provided in at least one of the top surface 11, the bottom surface 12, the end surface 15, and the end surface 16 of the packaging bag 10. Such an opening can be formed, for example, by forming a tearing cut line such as a perforation and tearing the tearing cut line.

Here, the tearing cut line indicates a cut line in which a cut and a tie (uncut portion between two cuts) are alternately arranged, and when the tie is broken, adjacent cuts on both sides become a continuous cut. The mode of cut of the tear-off cut line is not particularly limited, but preferably the tearing cut line penetrates the paper layer 10A, the resin layer and the resin layer 10C of the packaging bag (see FIG. 9).

In the packaging bag 10, a vent hole (not illustrated) may be provided in at least one of the top surface 11, the bottom surface 12, the side surface 13, the side surface 14, the end surface 15, and the end surface 16 of the packaging bag 10. The vent hole can function as an air hole of the packaging bag 10. The number, shape, and size of the vent holes are arbitrary. The form of the vent holes is arbitrary, but the vent holes preferably penetrate through the paper layer 10A, the resin layer 10B, and the resin layer 100 of the packaging bag (see FIG. 9).

Figure 4:
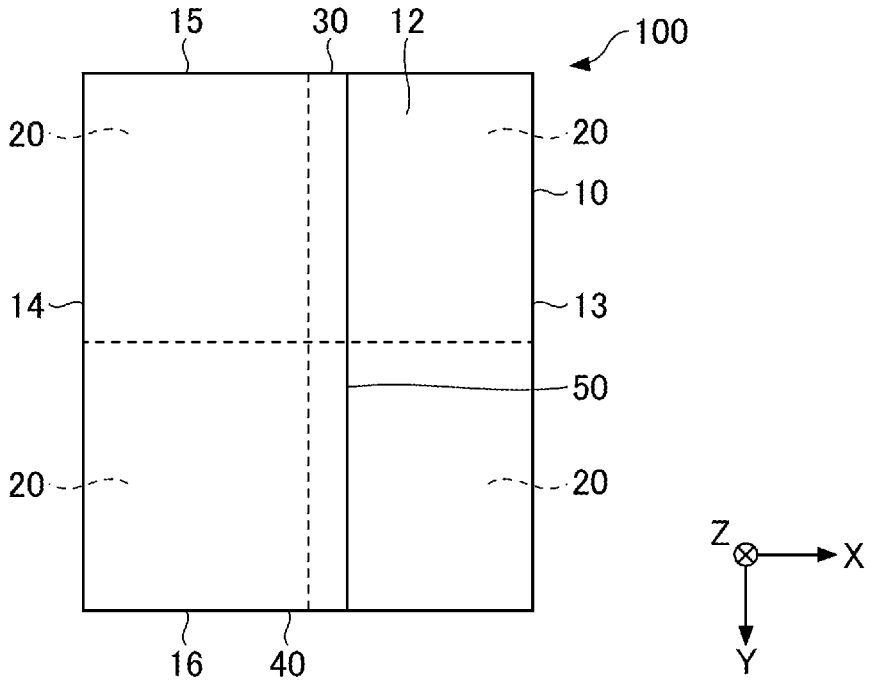
FIG. 4 is a diagram of the sheet package illustrated in FIG. 1 viewed from the bottom surface.
Figure 5:
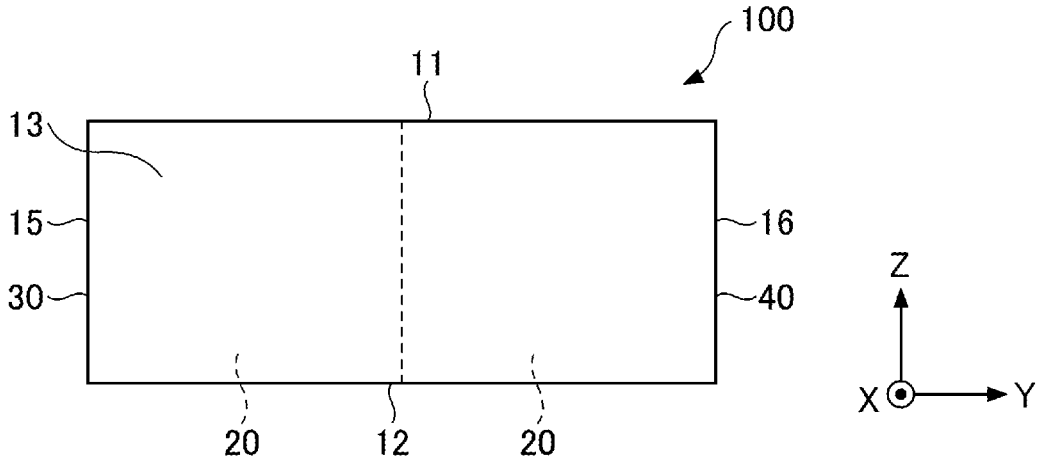
FIG. 5 is a diagram of the sheet package illustrated in FIG. 1 viewed from one side surface.
Figure 6:
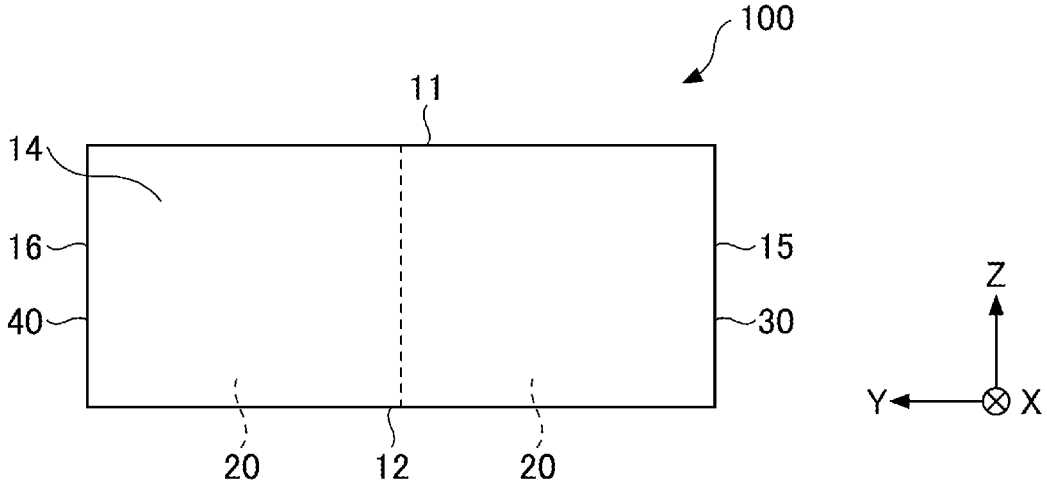
FIG. 6 is a diagram of the sheet package illustrated in FIG. 1 viewed from the other side surface.
Figure 7:
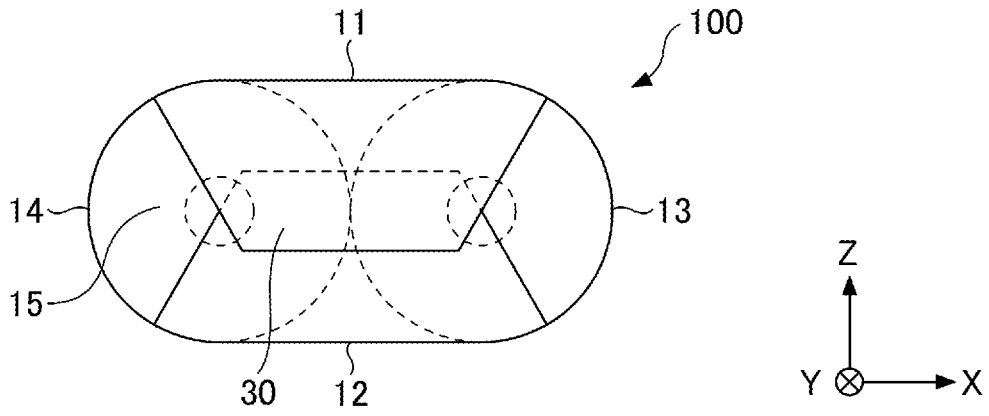
FIG. 7 is a diagram of the sheet package illustrated in FIG. 1 viewed from an end surface.
Figure 8:
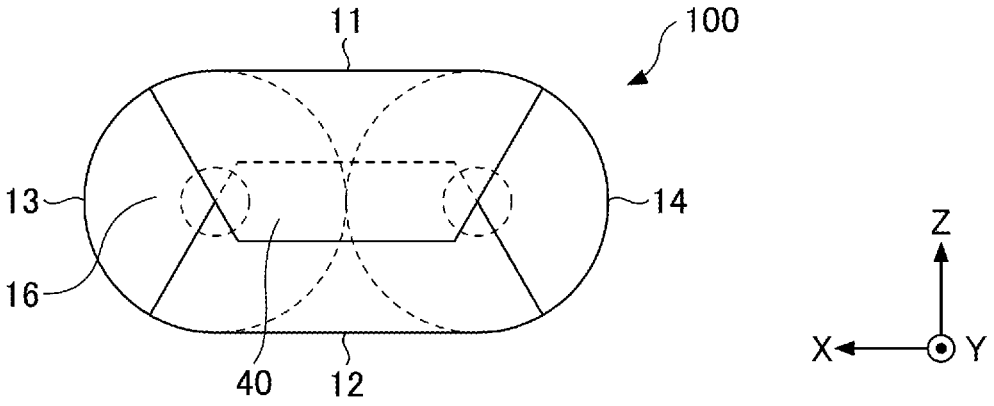
FIG. 8 is a diagram of the sheet package illustrated in FIG. 1 viewed from the other end surface.

The packaging bag 10 includes a pair of seal portion 30 and 40, at both ends in the longitudinal direction (Y-direction). The seal portions 30 and 40 are formed as side seals on the end surfaces 15 and 16 of the packaging bag 10 (FIGS. 1 and 3 to 8). A seal portion 50 is formed as a bottom seal on the bottom surface 12 of the packaging bag 10 (FIG. 4).

The packaging bag 10 is constituted from a packaging bag configured in a folded-packaged manner. Specifically, the seal portions 30 and 40 (side seals) of the end surfaces 15 and 16 are folded before being sealed (FIGS. 1 and 3 to 8). In the packaging bag configured in a folded-packaged manner, a packaging bag sheet (not illustrated) is supplied to a packaging machine (not illustrated), a sheet roll is set, bottom sealing is performed on the packaging bag sheet in the packaging machine, and then side sealing is performed (FIGS. 1, 4, 7, and 8).

The form of the seal portions 30, 40, and 50 is arbitrary. For example, the seal portions 30, and 50 are thermally welded. Here, thermal welding indicates that a portion of the packaging bag sheet is heated to weld the portion of the packaging bag sheet together. Specifically, the seal portions 30, 40, and are thermally welded in a state in which any one of the resin layers 10B and 10C of the packaging bag 10 is disposed inside the packaging bag 10 (FIGS. 1, 4, and 7 to 9).

The heating temperature in the thermal welding is arbitrary, but is preferably in a range from 120° C. to 180° C., more preferably in a range from 130° C. to 170° C., and even more preferably in a range from 140° C. to 160° C.

In addition, the seal strength in thermal welding is arbitrary, but is preferably in a range from 0.2 kN/m to 0.5 kN/m, more preferably in a range from kN/m to 0.49 kN/m, and even more preferably in a range from 0.22 kN/m to 0.48 kN/m. In the present specification, the seal strength refers to a seal strength measured in accordance with JIS 20238 (1998).

In the packaging bag 10, the pitch of overlapping of the seal portions 30, 40, and 50 is not particularly limited, but may be, for example, in a range from 80 mm to 400 mm, preferably in a range from 100 mm to 300 mm, and more preferably in a range from 160 mm to 200 mm.

Here, the pitch of wrapping of the seal portions 30 and 40 indicates the size in the height direction (Z-direction) of the bonding region where the folded portion on the top surface 11 side and the folded portion on the bottom surface 12 side overlap each other on the end surfaces 15 and 16 of the packaging bag 10. In addition, the pitch of wrapping of the seal portion 50 indicates the size in the width direction (X-direction) of an adhesion region in which both end portions in the longitudinal direction of the packaging bag sheet overlap each other on the bottom surface 12 of the packaging bag 10.

As described above, the packaging bag 10 of the present embodiment includes the resin layers 10B and 10C containing the thermoplastic resin provided on both surfaces of the paper-component-containing paper layer 10A, so that the packaging bag 10 can be softened. As a result, it is possible to suppress the feeling of roughness of the packaging bag 10 and to impart followability to the packaging bag 10. Therefore, according to the present embodiment, even in a case where the material of the packaging bag 10 is changed (shifted) from resin to paper, it is possible to provide the packaging bag 10 which is not easily broken during manufacturing or transportation.

In addition, in the present embodiment, since the resin layers 10B and 10C provided on both surfaces of the paper layer 10A include a thermoplastic resin, the resin layers 10B and 10C can be disposed on both the outer side and the inner side of the packaging bag 10. As a result, when the seal portions 30, 40, and 50 of the packaging bag 10 are heated, the resin layers 10B and 10C can function as an adhesive (have an adhesive function) both on the outer side and the inner side of the packaging bag 10. Therefore, in the present embodiment, even when the sheet roll 20 is subjected to be packaged in the packaging bag in a folded-packaged manner, sealing becomes easy, and the seal portions 30, 40, and 50 are not easily peeled off.

In the present embodiment, if the proportion of the paper component in the packaging bag is adjusted to 45% or more, the resin layer (the resin layer 10B or the resin layer 100) disposed inside the packaging bag 10 is less likely to adhere to the sheet roll 20 packaged in the packaging bag 10 even when the resin layers 10B and 10C function as an adhesive. In the present embodiment, the proportion of the paper component in the packaging bag 10 is 45% or more, resulting in suppressing the environmental load.

In the packaging bag 10 of the present embodiment, as described above, if the basis weight of the packaging bag 10 is in a range from 10 g/m$^2$ to 40 g/m$^2$, the strength of the packaging bag 10 can be maintained. Therefore, the present embodiment can provide the packaging bag 10 which is further difficult to tear.

In the present embodiment, as described above, the paper layer 10A is formed of kraft paper or rayon paper, resulting in maintaining the strength of the packaging bag 10.

In the present embodiment, as described above, if the thicknesses of the respective resin layers 10B and 10C provided on both surfaces of the paper layer is in a range from 5 μm to 40 μm, the proportion of the paper component in the packaging bag can be easily maintained at 45% or more. Further, the adhesive function of the resin layers 10B and 10C at the time of sealing the packaging bag can be maintained while suppressing the feeling of roughness of the packaging bag.

In the present embodiment, as described above, low-density polyethylene is used as the thermoplastic resin contained in each of the resin layers 10B and 10C, whereby the adhesive function of the resin layers 10B and 10C at the time of sealing the packaging bag 10 can be improved while further suppressing the feeling of roughness of the packaging bag 10.

In the present embodiment, as described above, in the packaging bag made of paper configured to package the sheet roll 20 in a folded-packaged manner, the tear strength in the longitudinal direction is in a range from 70 mN to 350 mN, and the tear strength in the lateral direction is in a range from 250 mN to 950 mN, whereby the flexibility and followability of the packaging bag 10 configured in a folded-packaged manner are improved. As a result, in the present embodiment, the packaging bag 10 configured in a folded-packaged manner which is not easily broken at the time of manufacture or transportation, is easily sealed, and is not easily peeled off at the seal portions 30, 40, and can be provided.

In the present embodiment, as described above, in the packaging bag made of paper configured to pack the sheet roll 20 in a folded-packaged manner, the softness in the longitudinal direction is in a range from 90 mN/100 mm to 800 mN/100 mm, and the softness in the lateral direction is in a range from 40 mN/100 mm to 330 mN/100 mm, whereby the flexibility and followability of the packaging bag 10 configured in a folded-packaged manner are further improved. As a result, in the present embodiment, the packaging bag 10 configured in a folded-packaged manner which is not easily broken at the time of manufacture or transportation, is easily sealed, and is not easily peeled off at the seal portions 30, 40, and 50, can be provided.

In the present embodiment, as described above, by configuring the sheet package 100 in which the sheet roll 20 is packaged in the packaging bag 10, the same effects as those of the above-described packaging bag 10 are obtained. That is, according to the present embodiment, a sheet package in which the packaging bag is not easily broken at the time of manufacture or transportation can be provided even when the packaging bag 10 is changed from a resin bag to a paper bag.

In the present embodiment, as described above, when the packaging bag 10 is sealed (or sealed), the melted resin layers 10B and 10C can function as an adhesive (have an adhesive function) by heating the resin layers 10B and 10C provided on both layers of the paper layer 10A. Therefore, even when the sheet roll is subjected to be packaged in the packaging bag in a folded-packaged manner, the packaging bag 10 can be easily sealed, and the sealed portions 30, 40, and 50 are hardly peeled off.

Further, in the present embodiment, as described above, if the proportion of the paper component in the packaging bag 10 is 45% or more, the sheet package 100 in which the resin layer (the resin layer 10B or the resin layer 100) disposed inside the packaging bag 10 is less likely to adhere to the sheet roll 20 packaged in the packaging bag 10 can be obtained, even when the resin layers 10B and 10C function as an adhesive. In addition, in the present embodiment, since the proportion of the paper component in the packaging bag 10 is 45% or more, the sheet package 100 that suppresses the environmental load can be obtained.

<Method of Manufacturing Packaging Bag>

The method of manufacturing the packaging bag according to the present embodiment is a method of manufacturing the above-described packaging bag 10. Specifically, the method of manufacturing includes a welding step of thermally welding the seal portions 30, and 50 of the packaging bag 10. In the welding step, thermal welding is performed by adjusting the heating temperature in a range from 120° C. to 180° C., preferably in a range from 130° C. to 170° C., more preferably in a range from 140° C. to 160° C.

In the welding step, the seal strength is preferably in a range from 0.2 kN/m to 0.5 kN/m, more preferably in a range from 0.21 kN/m to 0.49 kN/m, and even more preferably in a range from 0.22 kN/m to 0.48 kN/m. As the steps other than the welding step, steps used in a conventional method of manufacturing a packaging bag of a resin film can be employed.

According to the method of manufacturing the packaging bag according to the present embodiment, if the heating temperature is in a range from 120° C. to 180° C. in the welding step of thermally welding the seal portions 30, 40, and 50 of the packaging bag 10, the packaging bag 10 having high sealability can be obtained even when the material of the packaging bag is changed from resin to paper, as described above.

According to the method of manufacturing the packaging bag of the present embodiment, if the seal strength of the seal portions 30, 40, and 50 of the packaging bag 10 configured to pack the sheet roll 20 in a folded-packaged manner is in a range from to 0.5 kN/m, the seal portions 30, 40, and 50 are further less likely peeled off when the packaging bag 10 configured to pack the sheet roll 20 in a folded-packaged manner is changed from a resin-made packaging bag to a paper-made packaging bag, and the packaging bag 10 has high sealing properties.

EXAMPLES

Hereinafter, the present invention will be described more specifically with reference to Examples. Examples and Comparative Examples were evaluated by the following tests.

[Sample]

As a sample, a sheet package 100 in which four sheet rolls 20 were packed in a folded-packaged manner in a packaging bag 10 was prepared (FIGS. 1 to 8). The sheet roll 20, commercially available roll-shaped toilet paper (Flier Toilet Tissue, 55 m, 1-ply, 138 g/roll, manufactured by Daio Paper Corporation) was used.

[Basis Weight in Meters]

The basis weight in meters (basis weight) of the packaging bag 10 in the sample was measured in accordance with JIS P 8124 (2011). The unit of basis weight in meters is $g/m^2$.

[Thickness of Paper]

The paper thickness (thickness) of the packaging bag 10 in the sample was measured in accordance with JIS P 8118 (2014). The unit of the thickness is μm.

[Density]

The density of the packaging bag 10 in the sample was measured in accordance with JIS P 8118 (2014). The unit of density is $g/m^3$.

[Tensile Strength]

The tensile strength (mN) in the longitudinal direction (MD direction) and the lateral direction (CD direction) of the packaging bag 10 in the sample was measured using a Tensilon universal testing machine (RTG-1210, manufactured by A&D) in accordance with JIS P 8113 (2006).

[Elongation]

With respect to the packaging bag 10 in the sample, the elongation (%) in the longitudinal direction (MD direction) and the lateral direction (CD direction) was measured using a Tensilon universal testing machine (RTG-1210, manufactured by A&D) in accordance with JIS P 8113 (2006).

[Tear Strength]

With respect to the packaging bag 10 in the sample, the tear strength in the longitudinal direction (MD direction) and in the lateral direction (CD direction) of the fibers was measured using a tear strength tester (Elmendorf tearing tester (digital display type), manufactured by Kumagaya Riki Kogyo Co., Ltd.) in accordance with JIS P 8116 (2000)

[Softness]

The softness of the packaging bag 10 of the sample was measured by Handle-O-meter method in accordance with JIS L 1096 E method. The size of sample was 100 mm ×100 mm, and the clearance was 5 mm. The softness was measured five times in each of the longitudinal direction (MD direction) on the surface of the packaging bag 10 and the lateral direction (CD direction) on the surface of the packaging bag 10, with use of Handle-O-meter (handfeel meter, manufactured by Kumagaya Riki Kogyo Co., Ltd.), and the average value of the ten measurements was calculated with a unit represented by mN/100 mm. The surface of the packaging bag 10 indicates the surface facing to the resin layer 10B of the packaging bag 10 (FIG. 9).

[Heat-Sealing Strength]

The heat-sealing strength of the packaging bag 10 of the sample was confirmed. The heat-sealing strength was measured at 120° C., 140° C., 160° C., and 180° C. In the heat-sealing strength, using a load cell tensile tester (Tensilon RTG-1210 manufactured by A & D Corporation) and a thermal gradient tester (TYPE HG-100 manufactured by Toyo Seiki Seisaku-sho, Ltd.), the sample having a length of 300 mm in the longitudinal direction and a width of 120 mm in the lateral direction was folded inward in the longitudinal direction with the heat-sealed side facing inward, and the sample was sealed by the thermal gradient tester. At the time, the load was 1.0 kgf, the time was 1.0 seconds, and the temperatures were adjusted to four levels such as 120° C., 140° C., 160° C., and 180° C. Five heat blocks each having a length of 1.0 cm and a length of 2.5 cm (five blocks arranged side by side) were used, and the load of block was uniform. From the heat-sealed sample, a test piece for a heat-sealing strength measurement was obtained. The size of test piece was about 1.5 cm width×15 cm length, and the test piece included one heat block of the heat-sealed portion. The tensile test was performed by disposing both ends of the test piece so that the interval of chucks of the load cell tensile tester became 100 mm, and the heat-sealed portion was disposed at the center of the test piece.

[Paper Component (Proportion)]

The proportion (%) of the paper component was calculated from the specific gravity of the paper layer and the specific gravity of the resin layer for the packaging bag 10 of the sample.

[Adhesiveness of Side Seal]

The adhesiveness of the side seals (seal portions 30 and 40) of the sample was evaluated. When the sample was compressed by hand from the top surface 11 and the bottom surface 12, the case where the side seal (the seal portions 30 and 40) was not peeled was evaluated as ○ (good), the case where the side seal was broken was evaluated as Δ (slightly poor), and the case where the side seal was not adhered was evaluated as X (poor).

[Adhesiveness of Side Seals to Sheet Roll]

In the sample, the adhesiveness of the side seals (seal portions 30 and 40) to the sheet roll was evaluated. When the side seals (seal portions 30 and were peeled off, the case where the sheet roll 20 was not broken was evaluated as ○ (good), the case where the sheet roll 20 was adhered to the side seals of the packaging bag 10 was evaluated as Δ (slightly poor), and the case where the sheet roll 20 was adhered to the side seals of the packaging bag resulting in breaking the sheet roll 20 was evaluated as X (poor).

[Adhesiveness of Bottom Seal]

In the sample, the adhesiveness of the bottom seal (seal portion 50) was evaluated. The sample was compressed by hand from the top surface 11 and the bottom surface 12, and the case where the bottom seal (seal portion 50) was not peeled was evaluated as ○ (good), the case where the bottom seal was broken was evaluated as Δ (slightly poor), and the case where the bottom seal was not adhered was evaluated as X (poor).

[Adhesiveness of Bottom Seal to Sheet Roll]

In the sample, the adhesiveness of the bottom seal (seal portion 50) to the sheet roll was evaluated. When the bottom seal (seal portion 50) was peeled off, the case where the sheet roll 20 was not broken was evaluated as ○ (good), the case where the sheet roll 20 was adhered to the bottom seal of the packaging bag 10 was evaluated as Δ (slightly poor), the case where the sheet roll 20 was adhered to the bottom seal of the packaging bag resulting in breaking the sheet roll 20 was evaluated as X (poor).

[Breakage of Packaging Bag]

The sample was compressed by hand from the top surface 11 and the bottom surface 12, and whether or not the packaging bag 10 was broken was checked. The evaluation criteria were as follows: when the packaging bag 10 was not broken was evaluated as ○ (good); when the packaging bag 10 was not broken but not flexible was evaluated as Δ (slightly poor); and when the packaging bag 10 was broken was evaluated as X (poor).

Hereinafter, the materials used in Examples and Comparative Examples will be described.

[Material 1]

Rayon paper having a basis weight of 30 g/m$^2$ was used for the paper layer 10A, and low-density polyethylene having a basis weight of 10 g/m$^2$ and a thickness of 11 μm was used for the resin layers 10B and 10C (both surfaces of the paper layer 10A) to form a three-layered material 1. Properties of the material 1 (paper component (proportion), basis weight, thickness, density, tensile strength, elongation, tear strength, softness, and heat-sealing strength) are indicated in Table 1.

[Material 2]

A material 2 was prepared in the same manner as the material 1 except that the material 2 had kraft paper having a basis weight of 30 g/m$^2$ for the paper layer 10A and a low-density polyethylene having a basis weight of 14 g/m$^2$ and a thickness of 15 μm for the resin layers 10B and 10C (both surfaces of the paper layer 10A). The properties of the material 2 are indicated in Table 1.

[Material 3]

A material 3 was prepared in the same manner as the material 1 except that the material 3 had a two-layered structure of rayon paper having a basis weight of 20 g/m$^2$ for the paper layer 10A and a resin layer 10B (one side of the paper layer 10A). The properties of the material 3 are indicated in Table 1.

[Material 4]

A material 4 was prepared in the same manner as the material 1 except that the material 4 had a two-layered structure of a low-density polyethylene having a basis weight of 18 g/m$^2$ and a thickness of 20 μm for the resin layers 10B (one side of the paper layer 10A). The properties of the material 4 are indicated in Table 1.

[Material 5]

A material 5 was prepared in the same manner as the material 2 except that the material 5 had a two-layered structure of a low-density polyethylene having a basis weight of 27 g/m$^2$ and a thickness of 30 μm for the resin layers 10B (one side of the paper layer 10A). The properties of the material 5 are indicated in Table 1.

[Material 6]

A raw material 6 was formed in the same manner as the material 1 except that the packaging bag was formed only of the paper layer 10A and the paper layer 10A was formed of unbleached kraft paper having a basis weight of 65 g/m$^2$. The properties of the material 6 are indicated in Table 1.

Examples and Comparative Examples will be described below.

Example 1

The material 1 was used for the packaging bag 10, and the packaging bag 10 was configured to be used in a folded-packaged manner by heating the side seals at 142° C., heating the bottom seal at 110° C., and sealing speed at 50 m/sec. The adhesiveness of the side seals, the adhesiveness of the side seals to the sheet roll, the adhesiveness of the bottom seal, the adhesiveness of the bottom seal to the sheet roll, and the breakage of the packaging bag are indicated in Table 2.

Example 2

The packaging bag was prepared and evaluated in the same manner as in Example 1 except that the heating temperature of the side seals was changed to 147° C. The results are indicated in table 2.

Example 3

The packaging bag was prepared and evaluated in the same manner as in Example 1 except that the heating temperature of the side seals was changed to 152° C. The results are indicated in table 2.

Example 4

The packaging bag was prepared and evaluated in the same manner as in Example 1 except that the heating temperature of the side seals was changed to 157° C. The results are indicated in table 2.

Example 5

The packaging bag was prepared and evaluated in the same manner as in Example 1, except that the material 2 was used for the packaging bag 10; the heating temperature of the side seals was changed to 153° C.; and the heating temperature of the bottom seal was changed to 120° C. The results are indicated in Table 2.

Example 6

The packaging bag was prepared and evaluated in the same manner as in Example 5 except that the heating temperature of the side seals was changed to 157° C. The results are indicated in table 2.

Example 7

The packaging bag was prepared and evaluated in the same manner as in Example 5 except that the heating temperature of the side seals was changed to 161° C. The results are indicated in table 2.

Comparative Example 1

The packaging bag was prepared and evaluated in the same manner as in Example 1, except that the material 3 was used for the packaging bag 10; the heating temperature of the side seals was changed to 160° C.; and the heating temperature of the bottom seal was changed to 115° C. The results are indicated in Table 3.

Comparative Example 2

The packaging bag was prepared and evaluated in the same manner as in Comparative Example 1 except that the heating temperature of the side seals was changed to 165° C. The results are indicated in table 3.

Comparative Example 3

The packaging bag was prepared and evaluated in the same manner as in Example 1, except that the material 4 was used for the packaging bag 10; the heating temperature of the side seals was changed to 197° C.; the heating temperature of the bottom seal was changed to 205° C.; and the sealing speed was changed to 47 m/sec. The results are indicated in Table 3.

Comparative Example 4

The packaging bag was prepared and evaluated in the same manner as in Comparative Example 3 except that the heating temperature of the side seals was changed to 222° C.; the heating temperature of the bottom seal was changed to 222° C.; and the sealing speed was changed to 49 m/sec. The results are indicated in table 3.

Comparative Example 5

The packaging bag was prepared and evaluated in the same manner as in Comparative Example 4 except that the heating temperature of the side seals was changed to 170° C. and the heating temperature of the bottom seal was changed to 150° C. The results are indicated in table 3.

Comparative Example 6

The packaging bag was prepared and evaluated in the same manner as in Example 1, except that the material 5 was used for the packaging bag 10; the heating temperature of the side seals was changed to 170° C.; the heating temperature of the bottom seal was changed to 167° C.; and the sealing speed was changed to 49 m/sec. The results are indicated in Table 3.

Comparative Example 7

The packaging bag was prepared and evaluated in the same manner as in Example 1, except that the material 6 was used for the packaging bag 10; the heating temperature of the side seals was changed to 230° C.; the heating temperature of the bottom seal was changed to 250° C.; and the sealing speed was changed to 27 m/sec. The results are indicated in Table 3.

TABLE 1

| | | Material 1 | Material 2 | Material 3 | Material 4 | Material 5 | Material 6 |
|---|---|---|---|---|---|---|---|
| Properties of material | Paper layer (basis weight) | rayon (30 g/m$^2$) | kraft (30 g/m2) | rayon (20 g/m$^2$) | rayon (30 g/m$^2$) | kraft (30 g/m2) | kraft (unbleached) (65 g/m2) |
| | Resin layer (basis weight) (thickness) | polyethylene (10 g/m$^2$) (11 μm) | polyethylene (14 g/m$^2$) (15 μm) | polyethylene (10 g/m$^2$) (11 μm) | polyethylene (18 g/m$^2$) (20 μm) | polyethylene (27 g/m$^2$) (30 μm) | — |
| | Laminated structure | both surfaces | both surfaces | one side | one side | one side | — |
| | Paper component (proportion) | 48% | 52.4% | 53.3% | 49.8% | 52.4% | 92.9% |
| Basis weight | Basis weight (g/m$^2$) | 50.02 | 57.3 | 30.01 | 48.2 | 57.3 | 70 |
| Thickness | μm | 58 | 69 | 54 | 69 | 70 | — |
| Density | g/cm$^3$ | 0.73 | 0.84 | 0.57 | 0.67 | 0.82 | — |
| Tensile strength | longitudinal direction kN/m | 2.4 | 5.27 | 1.72 | 2.25 | 5.03 | — |
| | lateral direction kN/m | 0.66 | 1.37 | 0.4 | 0.59 | 1.32 | — |
| Elongation | longitudinal direction % | 3.3 | 3.7 | 3 | 2.4 | 3.3 | — |
| | lateral direction % | 5 | 4.7 | 3.4 | 3.1 | 3.7 | — |
| Tear strength | longitudinal direction mN | 233 | 180 | 190 | 293 | 225 | — |
| | lateral direction mN | 562 | 399 | 324 | 750 | 408 | — |

TABLE 1-continued

| | | Material 1 | Material 2 | Material 3 | Material 4 | Material 5 | Material 6 |
|---|---|---|---|---|---|---|---|
| Softness | longitudinal direction on the surface mN/100 mm | 299 | 655 | 243 | 650 | 721 | — |
| | lateral direction on the surface mN/100 mm | 154 | 292 | 83 | 227 | 308 | — |
| Heat sealing strength | kN/m (120° C.) | 0.22 | 0.29 | 0.17 | 0.06 | 0.03 | — |
| | kN/m (140° C.) | 0.3 | 0.45 | 0.31 | 0.23 | 0.64 | — |
| | kN/m (160° C.) | 0.34 | 0.36 | 0.33 | 0.24 | 0.65 | — |
| | kN/m (180° C.) | 0.32 | 0.42 | 0.29 | 0.25 | 0.66 | — |

15

| | | Example 1 | Example 2 | Example 3 | Example 4 | Example 5 | Example 6 | Example 7 |
|---|---|---|---|---|---|---|---|---|
| Conditions | Material | material 1 | material 1 | material 1 | material 1 | material 2 | material 2 | material 2 |
| | Side seal (° C.) | 142 | 147 | 152 | 157 | 153 | 157 | 161 |
| | Bottom seal (° C.) | 110 | 110 | 110 | 110 | 120 | 120 | 120 |
| | Speed (m/sec) | 50 | 50 | 50 | 50 | 50 | 50 | 50 |
| Evaluations | Side seal (adhesiveness) | ○ | ○ | ○ | ○ | ○ | ○ | ○ |
| | Side seal (adhesiveness to sheet roll) | ○ | ○ | ○ | ○ | ○ | ○ | ○ |
| | Bottom seal (adhesiveness) | ○ | ○ | ○ | ○ | ○ | ○ | ○ |
| | Bottom seal (adhesiveness to sheet roll) | ○ | ○ | ○ | ○ | ○ | ○ | ○ |
| | Breakage of packaging bag | ○ | ○ | ○ | ○ | ○ | ○ | ○ |

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Conditions | Material | material 3 | material 3 | material 4 | material 4 | material 4 | material 5 | material 6 |
| | Side seal (° C.) | 160 | 165 | 197 | 222 | 170 | 170 | 230 |
| | Bottom seal (° C.) | 115 | 115 | 205 | 222 | 150 | 167 | 250 |
| | Speed (m/sec) | 50 | 50 | 47 | 49 | 49 | 49 | 27 |
| Evaluations | Side seal (adhesiveness) | ○ | ○ | Δ | ○ | Δ | Δ | X |
| | Side seal (adhesiveness to sheet roll) | Δ | Δ | Δ | X | ○ | ○ | ○ |
| | Bottom seal (adhesiveness) | ○ | ○ | Δ | ○ | Δ | Δ | X |
| | Bottom seal (adhesiveness to sheet roll) | Δ | Δ | X | X | ○ | ○ | X |
| | Breakage of packaging bag | ○ | ○ | Δ | ○ | ○ | ○ | ○ |

According to Tables 1 and 2, in the sample in which the sheet roll 20 was packaged in the packaging bag 10 having the resin layers 10B and 10C provided on both sides of the paper layer 10A, and the proportion of the paper component was 45% or more, in a folded packed manner, all of the adhesiveness of the side seals, the adhesiveness of the side seals to the sheet roll, the adhesiveness of the bottom seal, the adhesiveness of the bottom seal to the sheet roll, and the breakage of the packaging bag were favorable (Examples 1 to 7).

On the other hand, according to Table 1 and Table 3, in the sample using the packaging bag in which only the resin layer 10B was provided on one surface of the paper layer 10A and the sample using the packaging bag 10 formed of only the paper layer 10A, at least one of the adhesiveness of the side seals, the adhesiveness of the side seals to the sheet roll, the adhesiveness of the bottom seal, the adhesiveness of the bottom seal to the sheet roll, and the breakage of the packaging bag was not favorable (Comparative Examples 1 to 7).

According to these results, the packaging bag to be configured to package the sheet in a folded-packaged manner includes a paper layer containing a paper component, a resin layer containing a thermoplastic resin provided on both surfaces of the paper layer, wherein a proportion of the paper component in the packaging bag is 45% or more, resulting in suppressing the deterioration of the packaging property.

Although the embodiments of the present invention have been described above, the present invention is not limited to the specific embodiments, and various modifications and changes can be made within the scope of the invention described in the claims.

Hereinafter, specific embodiments of the present invention will be described.

According to a first aspect of the present invention, a packaging bag configured to pack a sheet in a folded-packaged manner includes a paper layer including a paper component, a resin layer including a thermoplastic resin provided on both surfaces of the paper layer, wherein a proportion of the paper component in the packaging bag is 45% or more.

In the present specification, the folded-packaged manner refers to a packaging mode in which the bottom seal is applied to the sheet roll for the packaging bag in a state where the sheet roll is set in the packaging bag, and the side seals are further applied thereto. The resin layers provided on both surfaces of the paper layer indicate a resin layer laminated on both the front surface and the back surface of the paper layer.

In the first aspect, the resin layer containing thermoplastic resins are provided on both surfaces of the paper layer containing the paper component, thereby softening the packaging bag. As a result, a feeling of roughness of the packaging bag can be suppressed, and followability to the packaging bag can be imparted. Therefore, even when the material of the packaging bag is changed from resin to paper, a packaging bag that is not easily broken during manufacture or transportation can be provided.

In the first aspect, since the resin layers provided on both surfaces of the paper layer contain a thermoplastic resin, the resin layers can be disposed on both the outer side and the inner side of the packaging bag. As a result, when the seal portions of the packaging bag are heated, the resin layer can function as an adhesive (has an adhesive function) both on the outer side and the inner side of the packaging bag. Therefore, in the first aspect, even when the sheet is subjected to be packaged in a folded-packaged manner, sealing is easy, and the seal portions are not easily peeled off.

Furthermore, in the first aspect, if the proportion of the paper component in the packaging bag is adjusted to 45% or more, the resin layer disposed on the inner side of the packaging bag is less likely to adhere to the sheet packaged in the packaging bag even when the resin layer functions as an adhesive. In addition, according to the first aspect, since the proportion of the paper component in the packaging bag is 45% or more, a sheet package in which the environmental load is suppressed can be provided.

A second aspect according to the present invention is the packaging bag, wherein a basis weight of the paper layer is in a range from 10 g/m$^2$ to 40 g/m$^2$. In the present specification, the basis weight of the paper layer refers to a basis weight measured in accordance with JIS P 8124 (2011).

In the second aspect, if the basis weight of the paper layer is adjusted in a range from 10 g/m$^2$ to 40 g/m$^2$, the strength of the packaging bag can be maintained. Therefore, according to the second aspect, a packaging bag which is further resistant to breaking can be provided.

A third aspect of the present invention is a packaging bag, wherein the paper layer is formed of kraft paper or rayon paper. In the present specification, kraft paper refers to paper made from kraft pulp. In addition, rayon paper refers to a mixture of kraft pulp and rayon fibers chemically synthesized from wood pulp or the like. From the viewpoint of achieving both softness and strength of the packaging bag, rayon paper preferably contains rayon fibers in an amount of 20% by mass or less.

In the third aspect, the strength of the packaging bag can be maintained by forming the paper layer with kraft paper or rayon paper.

A fourth aspect according to the present invention is the packaging bag, wherein a thickness per one layer of the resin layer is in a range from 5 μm to 40 μm. In the present specification, the thickness of the resin layer refers to a thickness measured in accordance with JIS P 8118 (2014).

In the fourth aspect, if the thickness of each of resin layers provided on both surfaces of the paper layer is adjusted to in a range from 5 μm to 40 μm, the proportion of the paper component in the packaging bag is easily maintained at 45% or more. In addition, the adhesive function of the resin layer at the time of sealing the packaging bag can be maintained while suppressing the roughness feeling of the packaging bag.

A fifth aspect of the present invention is the packaging bag, wherein the thermoplastic resin is low-density polyethylene. In the fifth aspect, by using low-density polyethylene as the thermoplastic resin contained in each resin layer, the adhesion function of the resin layer at the time of sealing the packaging bag while further suppressing the roughness of the packaging bag can be improved.

A sixth aspect according to the present invention is a packaging bag, wherein a tear strength in a longitudinal direction is in a range from 70 mN to 350 mN, and a tear strength in a lateral direction is in a range from 250 mN to 950 mN. The term "tear strength" as used herein refers to a tear strength measured in accordance with JIS P 8116 (2000). The longitudinal direction is a flow direction of the fibers constituting the packaging bag, and the lateral direction is a direction orthogonal to the flow direction of the fibers constituting the packaging bag.

In the sixth aspect, when the tear strength in the longitudinal direction is in a range from 70 mN to 350 mN and the tear strength in the lateral direction is in a range from 250 mN to 950 mN in the packaging bag made of paper configured to package a sheet in a folded-packaged manner, the flexibility and followability of the packaging bag configured in a folded-packaged manner are improved. Thus, according to the sixth aspect, the packaging bag configured in a folded-packaged manner that is not easily broken during manufacture or transportation, is easily sealed, and has a seal portion that is not easily peeled off, can be provided.

A seventh aspect according to the present invention is a packaging bag, wherein a softness in a longitudinal direction is in a range from 90 mN/100 mm to 800 mN/100 mm, and a softness in a lateral direction is in a range from 40 mN/100 mm to 330 mN/100 mm. In the present specification, softness refers to softness measured in accordance with JIS L 1096 E method.

According to the seventh aspect, in the packaging bag made of paper configured to pack a sheet in a folded-packaged manner, the softness in the longitudinal direction is in a range from 90 mN/100 mm to 800 mN/100 mm, and the softness in the lateral direction is in a range from 40 mN/100 mm to 330 mN/100 mm, whereby the flexibility and followability of the packaging bag configured in a folded-packaged manner are further improved. Thus, according to the seventh aspect, the packaging bag configured in a folded-packaged manner that is not easily broken during manufacture or transportation, is easily sealed, and has a sealed portion that is not easily peeled off, can be provided.

An eighth aspect according to the present invention is a method of manufacturing the packaging bag according to any one of the first to seventh aspects, including a welding step of thermally welding a seal portion of the packaging bag, wherein a heating temperature in the welding step is in a range from 120° C. to 180° C. In the present specification, thermal welding indicates that a part of the sheet for a packaging bag is heated to weld the parts of the sheet for a packaging bag to each other.

According to the eighth aspect, in the packaging bag configured to pack a sheet in a folded-packaged manner, if the heat temperature at the time of thermally welding the seal portion of the packaging bag is in a range om 120° C. to 180° C., a packaging bag in which the seal portions are less likely peeled off and which has high sealing properties can be obtained, even when the packaging bag configured to package a sheet in a folded-packaged manner is changed from a resin-made packaging bag to a paper-made packaging bag.

A ninth aspect according to the present invention is a method of manufacturing a packaging bag, wherein a seal strength is in a range from 0.2 kN/m to kN/m. In the present specification, the seal strength refers to a seal strength measured in accordance with JIS 20238 (1998).

In the ninth aspect, if the seal strength of the seal portion of the packaging bag configured to package a sheet in a folded-packaged manner is in a range from 0.2 kN/m to 0.5 kN/m, a packaging bag having high sealing properties in which the seal portions are further less likely to be peeled off when the packaging bag configured to package a sheet in a folded-packaged manner is changed from a resin-made packaging bag to a paper-made packaging bag.

A tenth aspect of the present invention is a sheet package including the packaging bag according to any one of the first to seventh aspects and a sheet packaged in the packaging bag. In the tenth aspect, by configuring the sheet package in which the sheet is packaged in the above-described packaging bag, the same effect as that of the above-described packaging bag can be obtained. That is, according to the tenth aspect, a sheet package in which the packaging bag is not easily broken at the time of manufacture or transportation can be provided even when the packaging bag is changed from a resin-made packaging bag to a paper-made packaging bag.

In addition, in the tenth aspect, since the melted resin layer can function as an adhesive (has an adhesive function) by heating the resin layers provided on both surfaces of the paper layer when the packaging bag is sealed (or sealed), a sheet package in which the packaging bag can be easily sealed even when the packaging bag is configured to package a sheet in a folded-packaged manner and in which the sealed portions are not easily peeled off can be provided.

Furthermore, in the tenth aspect, if the proportion of the paper component in the packaging bag is 45% or more, a sheet package in which the resin layer disposed on the inner side of the packaging bag is unlikely to adhere to the sheet packaged in the packaging bag can be obtained, even when the resin layer functions as an adhesive. In addition, according to the tenth aspect, since the proportion of the paper component in the packaging bag is 45% or more, the sheet package which suppresses the environmental load can be obtained.

The present application is based on and claims priority to Japanese Patent Application No. 2021-25872, filed on Feb. 22, 2021, the entire contents of which are hereby incorporated by reference.

DESCRIPTION OF THE REFERENCE NUMERALS

100 sheet package
10 packaging bag
10A paper layer
10B, 10C resin layer
11 top surface
12 bottom surface
13, 14 side surface
15, 16 end surface
20 sheet roll
21 long sheet
21A circumferential surface
21B, 21C end surface
22 hollow core
30, 40 seal portion (side seal)
50 seal portion (bottom seal)
L1 length
L2 roll width
W1 width
W2 roll diameter
H1 height

The invention claimed is:

1. A packaging bag configured to pack a sheet in a folded-packaged manner, comprising:
a paper layer including a paper component;
a resin layer including a thermoplastic resin provided on both surfaces of the paper layer;
wherein a proportion of the paper component in the packaging bag is 45% or more; and
wherein the proportion of the paper component is calculated based on a specific gravity of the paper layer and a specific gravity of the resin layer.

2. The packaging bag according to claim 1,
wherein a basis weight of the paper layer is in a range from 10 g/m$^2$ to 40 g/m$^2$ inclusive.

3. The packaging bag according to claim 1,
wherein the paper layer is formed of kraft paper or rayon paper.

4. The packaging bag according to claim 1,
wherein a thickness per a layer of the resin layer is in a range from 5 μm to 40 μm inclusive.

5. The packaging bag according to claim 1,
wherein the thermoplastic resin is a low-density polyethylene.

6. The packaging bag according to claim 1,
wherein a tear strength in a longitudinal direction is in a range from 70 mN to 350 mN inclusive, and
wherein a tear strength in a lateral direction is in a range from 250 mN to 950 mN inclusive.

7. The packaging bag according to claim 1,
wherein a softness of the packaging bag in a longitudinal direction is in a range from 90 mN/100 mm to 800 mN/100 mm inclusive, and
wherein a softness of the packaging bag in a lateral direction is in a range from 40 mN/100 mm to 330 mN/100 mm inclusive.

8. A sheet package comprising:

the packaging bag according to claim 1; and a sheet packaged in the packaging bag.

* * * * *